United States Patent [19]

Meyer et al.

[11] 4,174,105

[45] Nov. 13, 1979

[54] PLAYER ACTUATED FLYING TOY

[75] Inventors: Burton C. Meyer, Downers Grove; Alan A. Hicks, Chicago, both of Ill.

[73] Assignee: Marvin Glass & Associates, Chicago, Ill.

[21] Appl. No.: 876,405

[22] Filed: Feb. 10, 1978

[51] Int. Cl.[2] ..... A63H 27/04

[52] U.S. Cl. ..... 272/31 A; 74/30

[58] Field of Search ..... 272/31 R, 31 A, 31 B; 74/30, 31

[56] References Cited

U.S. PATENT DOCUMENTS

| | | | |
|---|---|---|---|
| 71,820 | 12/1867 | Thompson | 74/30 |
| 734,681 | 7/1903 | Dorsey | 272/31 R |
| 1,034,654 | 8/1912 | Smith | 272/31 A X |
| 1,087,965 | 2/1914 | Meredith-Jones | 74/30 |
| 2,114,212 | 4/1938 | Christiansen | 272/31 A |
| 2,595,061 | 4/1952 | Downey | 272/31 A |

FOREIGN PATENT DOCUMENTS

| | | | |
|---|---|---|---|
| 952515 | 5/1949 | France | 272/31 A |
| 1123908 | 6/1956 | France | 272/31 R |
| 242646 | 5/1946 | Switzerland | 272/31 A |

*Primary Examiner*—Richard C. Pinkham

*Assistant Examiner*—Arnold W. Kramer

*Attorney, Agent, or Firm*—Mason, Kolehmainen, Rathburn & Wyss

[57] ABSTRACT

A game apparatus includes a generally vertically oriented rotatable shaft mounted on a base and a playing object pivotally connected to the top of the shaft for operator controlled movement. A drive mechanism is mounted within the base and includes first and second plates mounted for reciprocal translatory movement. The second plate includes a longitudinal slot surrounding a drive gear or ratchet secured to the shaft. The slot includes opposing ratchet teeth pitched in opposite directions for alternate engagement with the drive gear. The second plate is connected to the first plate for relative movement such that one set of ratchet teeth engages the gear upon reciprocal movement of the first plate in a first direction and the other set of ratchet teeth engages the gear upon movement of the first plate in a second direction to rotate the drive gear in a single selected direction. The playing object includes a tiltable arm secured to the top of the shaft and a toy airplane on one end of the arm and a centrifugally operated weight on the other end that varies the elevation of the toy airplane relative to the base in proportion to the speed of rotation of the shaft.

3 Claims, 5 Drawing Figures

PLAYER ACTUATED FLYING TOY

BACKGROUND OF THE INVENTION

1. Field of the Invention

The present invention relates generally to a new and improved game apparatus of the type including an object that is rotated at various elevations and speeds according to the operator.

2. Brief Description of the Prior Art

Many of the more popular present day toys and games include playing objects whose direction of movement and speed are controlled by the players of the game. Further enjoyment and challenge from the game may be obtained if the players of the game are able to use their skill to control the movement of the playing object and to stop it at a desired location. Particular enjoyment is obtained when the skill of the player is required to control many variables for the operation of the object such as the speed and elevation.

One of the difficulties in providing such a game is that with more variables to be controlled by the player, more controls or energy-producing devices are required and more operations must be performed, thus requiring the player to operate several different switches or levers increasing the complexity of the game and reducing the enjoyment.

SUMMARY OF THE INVENTION

An object of the present invention is to provide a new and improved game apparatus including a playing object whose movement is controlled by the players of the game.

Another object of the present invention is to provide a new and improved game apparatus including a playing object whose speed, location and elevation are controlled by the player.

A further object of the present invention is to provide a new and improved game apparatus including a rotating playing object in the shape of a toy airplane whose speed, elevation and location are controlled by an operator through the employment of a single mechanism that requires only reciprocal movement by the player.

The present invention is directed to a new and improved game apparatus which includes a generally vertical shaft rotatably mounted at one end to a base. An arm is pivotally connected to the top of the shaft and carries on one end a playing object. The pivotal connection is such that the position of the playing object relative to the base may be varied vertically.

The vertical shaft is mechanically coupled to a translatory motion member that may be reciprocated by the player of the game apparatus. The reciprocal translatory movement of the member imparts a rotation, in a single direction, to the shaft and the speed of rotation of the shaft is controlled by the speed of reciprocation of the member.

In addition, a variable position weight is connected to the arm on the opposite end of the arm from the playing object. As the rotational speed of the shaft is varied, the location of the weight relative to the vertical shaft is varied, thus varying the vertical or elevational position of the playing object relative to the base. Thus, by increasing the speed of the reciprocal movement of the member, the rotational speed of the shaft and the elevation of the object are varied.

BRIEF DESCRIPTION OF THE DRAWINGS

The above and other objects and advantages and novel features of the present invention will become apparent from the following detailed description of a preferred embodiment of the invention illustrated in the accompanying drawings wherein.

DESCRIPTION OF THE PREFERRED EMBODIMENT

Figure 1:
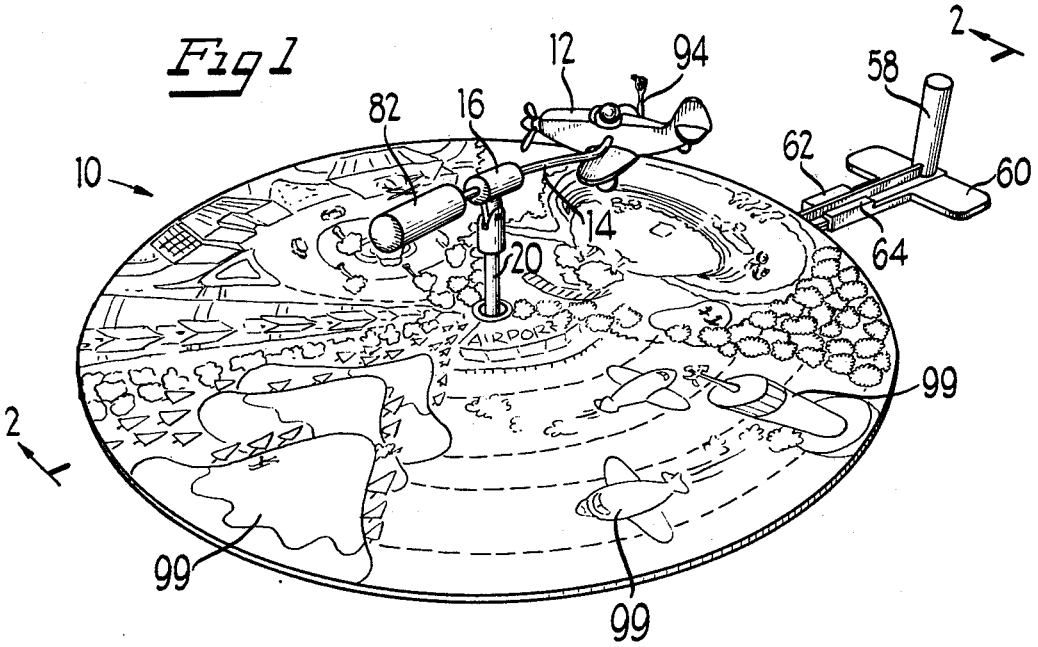
FIG. 1 is a perspective view of a game apparatus made in accordance with the concepts of the present invention.

Having reference now to the drawings and initially to FIG. 1, a game apparatus generally designated by the reference numeral 10 is illustrated. The game apparatus 10 includes a playing object 12 that in the embodiment illustrated is in the form of an airplane. The location of the airplane 12 and its movement, rotational speed, and elevation are controlled by the player as described below.

The airplane 12 is connected by a generally horizontal arm or rod 14 to a mounting member 16 that is pivotally coupled by a pin 17 within a slot 18 defined in a rotatable shaft 20. This mounting is such that the mounting member 16 may pivot approximately 180° about the pin 17 to vary the elevation of the airplane 12 relative to the ground or in the embodiment illustrated to a playing board 24. Thus, by pivoting the mounting member 16 relative to the shaft 20, the airplane 12 may be lifted from the game board 24 to an elevation of several inches.

It is also desired that the airplane 12 travel in a circular path relative to the shaft 20. This is accomplished by connecting the shaft 20 to a rotating assembly generally designated by the reference numeral 26. The rotating assembly 26 includes a first gear 28 that is integrally formed in a stepped configuration including a first shoulder 30 and a cylindrical extension 32. The cylindrical extension 32 is inserted into a hollow end 34 of the shaft 20 and secured by a set screw 36 extending through the side of the shaft 20. As the gear 28 is rotated, rotational movement is imparted to the shaft 20 and thus to the airplane 12, causing the airplane to rotate, travelling in a circular path.

Figure 3:
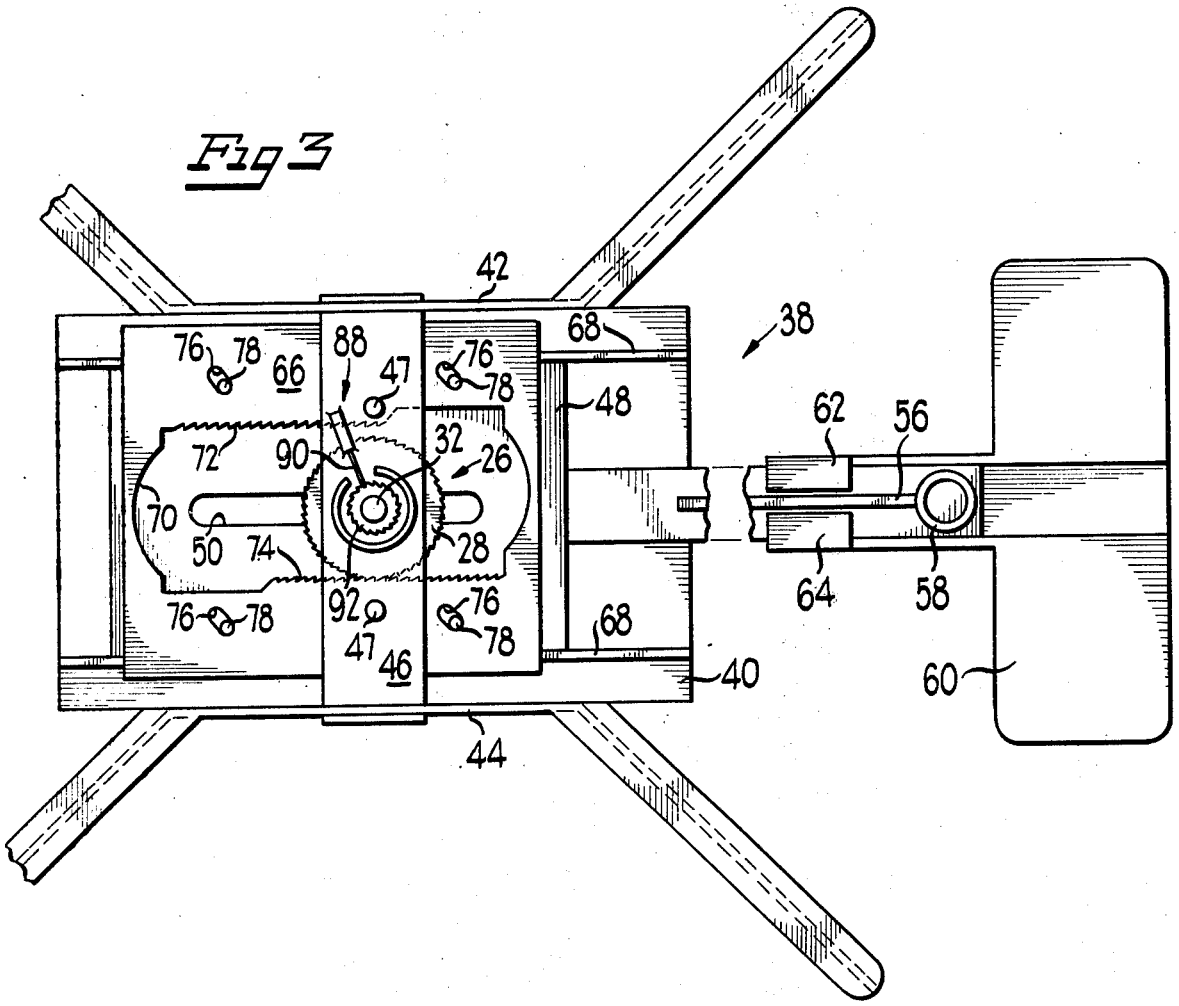
FIG. 3 is a vertical section taken generally along line 3—3 of FIG. 2.
Figures 2, 4, 5:
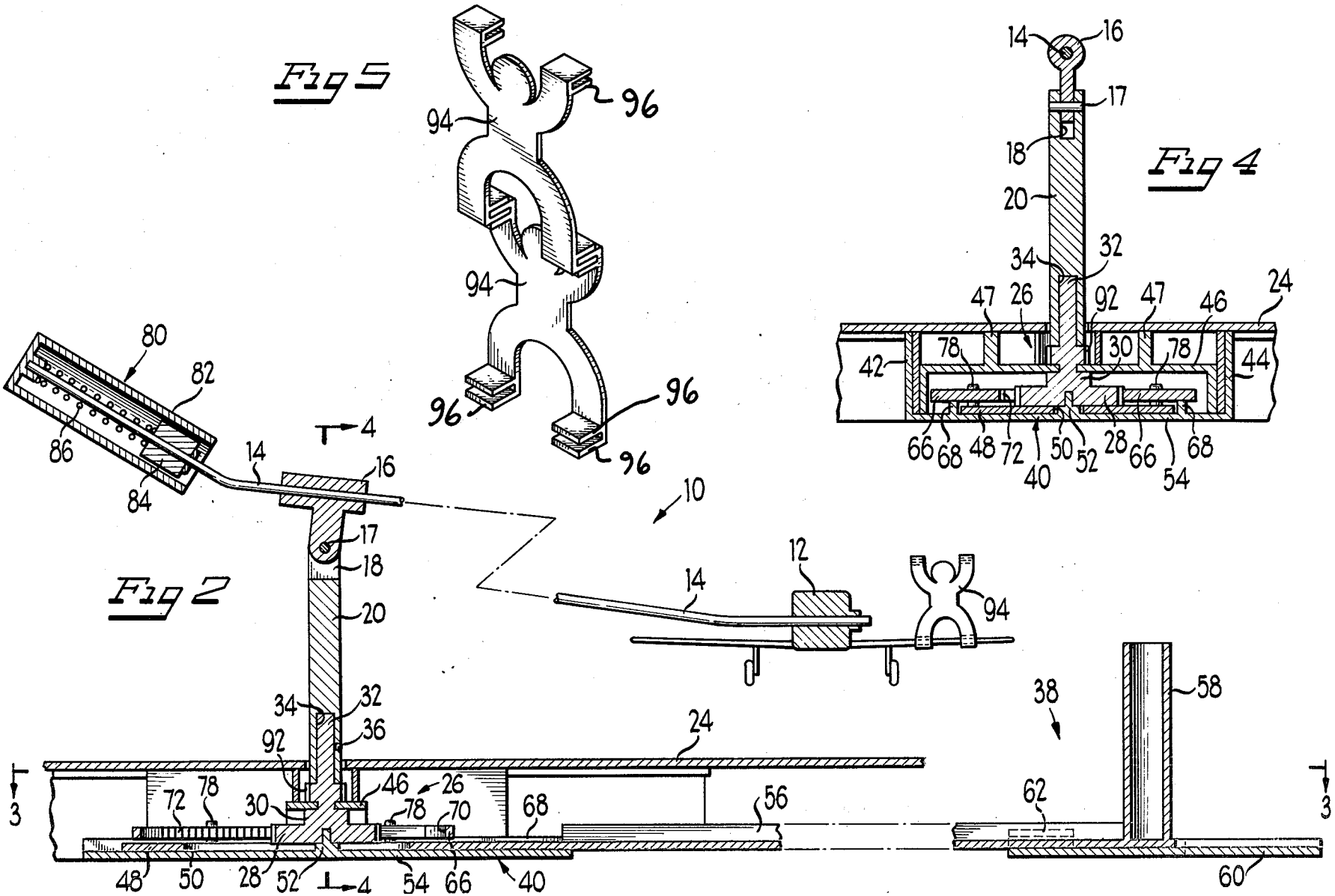
FIG. 2 is a partially fragmented, vertical cross-sectional view of the apparatus taken generally along line 2—2 of FIG. 1.
FIG. 4 is a horizontal section taken generally along line 4—4 of FIG. 2.
FIG. 5 is a perspective view of two figure toys for use with the present invention.

An important feature of the present invention is that the rotation of the gear 28 and thus the shaft 20 is in a single direction. The gear 28 is rotated by an assembly or drive means operated by reciprocal motion by the player of the game apparatus 10. The translatory reciprocal motion imparted by the player is translated to a rotational motion in one direction resulting in the constant rotational movement of the airplane 12 in the same direction. The motivating, reciprocating motion is provided by a mechanism generally designated by the reference numeral 38 (FIGS. 2 and 3). The reciprocating mechanism 38 includes a base 40 (FIG. 4) of a U-shaped configuration including side walls 42 and 44. A U-shaped support member 46 is also included on the base 40 and includes ribs 47 to support the game board 24 and side walls that define a track within which a reciprocating plate 48 is mounted.

The reciprocating plate 48 includes a central longitudinal slot 50 through which extends an axle 52 molded on the bottom 54 of the base 40 to support the gear 28. The reciprocating plate 48 is secured to a rod 56 having a handle 58 mounted on an end opposite the plate 48. The rod 56 and handle 58 are mounted on a platform 60 that defines a player station and includes overlapping flanges 62 and 64 that define a guide for the rod 56. A player may grasp the handle 58 and slide the rod 56 relative to the platform 60 thus reciprocating the plate 48 within the track defined by the member 46. A second plate 66 is also mounted within the housing 46 and supported above the plate 48 by a pair of ribs 68 integrally formed on the base 54. The plate 66 includes an enlarged central slot 70 of a transverse dimension greater than the diameter of the gear 28 such that the sides of the slot 70 are spaced from the outer periphery of the gear 28. Defined on opposite sides of the slot 70 are first 72 and second 74 sets of ratchet teeth, of opposite pitch. Upon engagement of one of the sets of ratchet teeth 72 or 74 with the outer periphery of the gear 28, there is a meshing of the teeth and subsequent reciprocation of the plate 66 will impart rotational movement of the gear 28.

In order to couple the reciprocal, translatory cycle of the plate 48 to the gear 28 and to couple this motion to the gear 28 such that the gear is always rotated in the same direction, the plate 66 includes several elongated slots 76 that are oriented at an angle relative to the plate 66. The bottom plate 48 includes a plurality of pins 78 which extend into the slots 76. The pins 78 are of a dimension such that they are smaller than the slot 76 and are free to move from one end of the respective slot 76 to the other. Through the employment of the slots 76 and the pins 78, reciprocation of the plate 48 to the right as viewed in FIG. 3, for example, results in pins 78 engaging the lower ends of the slots 76 in the position illustrated in FIG. 3. As the pins 78 slide along the slot 76 to the position illustrated in FIG. 3, the plate 66 through a camming action is moved in an angular direction to a position such that the set of ratchet teeth 74 engage the outer periphery of the gear 28. As a result of this engagement, the gear 28 is rotated in a counterclockwise direction as the handle 58 is moved to the right as viewed in FIG. 3.

Once the player has pulled the handle 58 to the farthest righthand position as illustrated in FIG. 3, the player may reverse the direction of movement of the handle 58 thus moving the bottom plate 48 in a leftward direction as viewed in FIG. 3. As this occurs, the pins 78 move within the slots 76 to engage the opposite ends of the slots 76. As this motion occurs, the camming action, due to the engagement of the pins 78 with the angled slots 76, moves the plate 66 to a position such that the set of ratchet teeth 72 engage the outer periphery of the gear 28. Thus, during this reciprocating cycle of movement of the handle 58 by the player, the gear 28 is always rotated in a counterclockwise rotation. Consequently, the player is able to impart counterclockwise rotation to the airplane 12. The speed of rotation of the airplane 12 can be controlled by the speed of reciprocation of the handle 58.

In order to vary the elevation of the airplane 12 relative to the ground or playing board 24, a variable counterweight or centrifugal device, generally designated by the reference numeral 80, is provided. The counterweight device 80 includes a tubular housing 82 connected to the opposite end of the rod 14. The rod 14 extends through the mounting block 16 and into the housing 82 such that the variable counterweight device 80 is on the opposite side of the shaft 20 from the airplane 12.

A weight 84 is slidably mounted on the rod 14 and biased in a direction towards the shaft 20 by a spring 86 coiled around the rod 14 between the end of the housing 82 and the weight 84. Upon rotation of the shaft 20, centrifugal force moves the weight 84 outwardly against the bias of the spring 86 along the rod 14 thus varying the position of the weight 84 relative to the mounting block 16. Consequently, as the airplane 12 is rotated at a greater speed due to more rapid reciprocation of the handle 58, the weight 84 moves along the rod 14 away from the mounting member 16. This movement results in lifting or elevating the plane 12. Conversely, as the rotation of shaft 20 is decreased, the weight 84 under the bias of the spring 86 is moved toward the mounting member 16, thus reducing the elevation of the plane 12.

To add further realism to the game apparatus 10, a sounding device, generally designated by the reference numeral 88, may be included. The sounding device 88 includes a leaf spring 90 mounted on the base for engagement with a small gear 92 secured to the shaft 20. As the shaft 20 is rotated, the teeth of the gear 92 engage the leaf spring 90 causing an audible sound to be generated similar to the sound created by an airplane.

In addition, to add more realism and playability to the game, a plurality of figure toys 94 (FIG. 5) are provided for use with the invention as described below. Specifically, each of the figure toys 94 is generally a two-dimensional figure having a pair of laterally extending flanges 96 at the end of each of its extremities. These flanges 96 are spaced apart a predetermined distance so that they may interfit and frictionally secure two figure toys 94 together as shown in FIG. 5. In addition, the wings of the airplane 12 are similarly dimensioned so that the flanges 96 will frictionally engage and support one or more of the figure toys 94 on the wing as shown in FIGS. 2 and 1. The addition of the figure toys 94 adds playability to the game since, while one of the players is operating the flight path of the airplane 12, another player may attempt, with an implement, or simply by hand, to attempt to dislodge the figure toys 94 which have been secured to the wing of the airplane 12 while the "pilot" attempts to dodge and prevent such a successful attack.

In addition, indicia 99 may be imprinted on the playing board 24 to designate a landing strip, a control tower, mountains or similar features associated with an airport in accordance with the game. It should be noted, however, that the playing board 24 is not a necessary component of the game apparatus 10 and other playing boards or devices or no playing board at all may be employed.

Many modifications and variations of the present invention are possible in light of the above teachings. Thus, it is to be understood that, within the scope of the appended claims, the invention may be practiced other than as specifically described above.

What is claimed and desired to be secured by Letters Patent of the United States is:

1. An action toy having an airplane rotated at a speed and elevation as controlled by a player of the toy, comprising:

a base including an enlarged platform area defining a playing surface generally below the area of movement of the airplane;

a generally vertical rotatable shaft mounted at the center of the playing surface;

a support arm pivotally connected to the top of said shaft having the airplane connected to a first end of said arm;

a centrifugal elevating means mounted at the opposite end of said arm at an angle relative to the length of the arm;

a rotatable drive gear secured to the bottom of said shaft, generally below said platform;

a first plate slidably mounted on said base for reciprocal sliding movement generally transverse to said shaft;

manually operable means mounted exteriorly of the periphery of said platform to permit reciprocating of said first plate by a player of the game;

a drive plate mounted on said first plate including a pair of sets of teeth for engaging and rotating said gear, a first set of said teeth engaging and rotating said gear upon movement of said drive plate in a first direction and a second set of teeth for engaging said gear upon movement of said drive plate in a second direction; and lost motion means between said first plate and said drive plate for moving said drive plate, in response to operation of said manually operable means for engaging the respective set of teeth with said gear whereby the speed of rotation of said shaft and altitude of said airplane is controlled by the operation of said manually operable means by a player of the game.

2. The toy of claim 1 wherein said lost motion means comprises a plurality of slots on one of said plates and a similar plurality of cam followers on the other of said plates whereby the sets of teeth on the drive plate are alternately moved into engagement with the drive gear upon operation of the manually operable means in opposite directions.

3. The toy of claim 1 further comprising means for producing an auditory effect upon rotation of said shaft.

* * * * *